US010926376B2

(12) United States Patent
Nakanishi et al.

(10) Patent No.: US 10,926,376 B2
(45) Date of Patent: Feb. 23, 2021

(54) METHOD AND APPARATUS FOR POLISHING A SUBSTRATE, AND METHOD FOR PROCESSING A SUBSTRATE

(71) Applicant: Ebara Corporation, Tokyo (JP)

(72) Inventors: Masayuki Nakanishi, Tokyo (JP); Yu Ishii, Tokyo (JP); Kenya Ito, Tokyo (JP); Keisuke Uchiyama, Tokyo (JP); Makoto Kashiwagi, Tokyo (JP)

(73) Assignee: Ebara Corporation, Tokyo (JP)

( * ) Notice: Subject to any disclaimer, the term of this patent is extended or adjusted under 35 U.S.C. 154(b) by 340 days.

(21) Appl. No.: 16/003,779

(22) Filed: Jun. 8, 2018

(65) Prior Publication Data

US 2019/0054594 A1 Feb. 21, 2019

(30) Foreign Application Priority Data

Aug. 17, 2017 (JP) ..... JP2017-157599

(51) Int. Cl.

| | |
|---|---|
| ***B24B 55/12*** | (2006.01) |
| ***B24B 21/00*** | (2006.01) |
| ***B24B 41/06*** | (2012.01) |
| ***B24B 47/12*** | (2006.01) |
| ***B24D 11/02*** | (2006.01) |
| ***B24B 21/08*** | (2006.01) |
| ***B24B 7/22*** | (2006.01) |

(52) U.S. Cl.

CPC ..... *B24B 55/12* (2013.01); *B24B 7/228* (2013.01); *B24B 21/004* (2013.01); *B24B 21/08* (2013.01); *B24B 41/067* (2013.01); *B24B 47/12* (2013.01); *B24D 11/02* (2013.01)

(58) Field of Classification Search

CPC ..... B24B 55/12; B24B 7/228; B24B 21/04; B24B 21/08; B24B 41/067; B24B 47/12; B24D 11/02

See application file for complete search history.

(56) References Cited

U.S. PATENT DOCUMENTS 8,087,419 B2 * 1/2012 Kaneko ..... H01L 21/68707 134/157
8,915,770 B2 * 12/2014 Lee ..... B24D 13/12 451/65
9,566,616 B2 2/2017 Togawa et al.
(Continued)

FOREIGN PATENT DOCUMENTS

JP 2012-222044 A 11/2012
JP 2015-012200 A 1/2015

*Primary Examiner* — Dung Van Nguyen
(74) *Attorney, Agent, or Firm* — Leydig, Voit and Mayer, Ltd.

(57) ABSTRACT

A method and an apparatus which can efficiently polish an entirety of a back surface, including an outermost area thereof, of a substrate while the back surface of the substrate faces downward are disclosed. The method includes rotating a substrate by rotating a plurality of rollers about their respective own axes while the rollers contact a periphery of the substrate with a back surface of the substrate facing downward; and polishing an entirety of the back surface of the substrate by moving a polishing tool relative to the substrate while supplying a liquid onto the back surface of the substrate and while placing the polishing tool in contact with the back surface of the substrate, the polishing tool being located at a lower side of the substrate.

17 Claims, 8 Drawing Sheets

(56) References Cited

U.S. PATENT DOCUMENTS

| | | | | |
|---|---|---|---|---|
| 9,773,686 | B2 * | 9/2017 | Tanaka | H01L 21/68728 |
| 2002/0029431 | A1 * | 3/2002 | Oikawa | B08B 3/04 15/77 |
| 2014/0220866 | A1 * | 8/2014 | Ishii | B24B 7/228 451/41 |

* cited by examiner

METHOD AND APPARATUS FOR POLISHING A SUBSTRATE, AND METHOD FOR PROCESSING A SUBSTRATE

CROSS REFERENCE TO RELATED APPLICATION

This document claims priority to Japanese Patent Application Number 2017-157599 filed Aug. 17, 2017, the entire contents of which are hereby incorporated by reference.

BACKGROUND

Devices, such as memory circuits, logic circuits and image sensors (e.g. CMOS sensors) are becoming more highly integrated these days. In a process for forming such devices, foreign matter, such as fine particles and dust, may adhere to the devices. Foreign matter adhering to a device can cause a short-circuit between interconnects or can cause a circuit failure. Therefore, in order to enhance the reliability of the device, it is necessary to clean a wafer on which the device is formed to remove the foreign matter on the wafer.

The above-described foreign matter, such as fine particles and dust, may adhere also to a back surface (or a non-device surface) of a wafer. If such foreign matter adheres to the back surface of the wafer, the wafer can separate from or become inclined with respect to a stage reference surface of an exposure apparatus, resulting in patterning shift or focal distance shift. In order to prevent such problems, it is necessary to remove the foreign matter adhering to the back surface of the wafer.

A patterning device, which uses nanoimprint technology instead of optical exposure technology, has recently been developed. The nanoimprint technology involves pressing a patterning mold against a resin material that has been applied to a wafer, thereby transferring an interconnect pattern to the resin material. In order to avoid transfer of a contaminant between a mold and a wafer and between wafers in such a nanoimprint process, it is necessary to remove foreign matter present on a surface of a wafer. In view of this, an apparatus has been proposed which rubs a polishing tool against a wafer under high load while supporting a lower side of the wafer with a high-pressure fluid, thereby slightly scraping away the surface of the wafer.

The conventional apparatus performs polishing of a wafer surface while rotating the wafer using a substrate rotating mechanism (see, for example, Japanese Laid-open Patent Publication No. 2015-12200). The substrate rotating mechanism includes a plurality of chucks for gripping the periphery of the wafer, and an annular hollow motor for rotating the wafer through the chucks. The wafer, with its to-be-polished surface facing upward, is held horizontally by the chucks, and is rotated about an axis of the wafer, together with the chucks, by the hollow motor. A polishing head, provided with a polishing tool, is disposed at an upper side of the wafer. This polishing head is located inwardly of the periphery of the wafer held by the chucks so that the polishing head does not contact the rotating chucks. As a result, the outermost area of the wafer surface is not polished, and needs to be polished separately by using an edge polishing apparatus.

The conventional apparatus may be provided in a substrate processing system capable of performing a series of processes including polishing, cleaning, and drying of a surface of a wafer. In such a substrate processing system, a plurality of wafers, with their device surfaces facing upward, are stored in a wafer cassette. Therefore, in order to polish a back surface of each wafer with the conventional apparatus, it is necessary to reverse the wafer in the process of transporting the wafer from the wafer cassette to the polishing apparatus. In addition, it is necessary to reverse the wafer again before returning the polished wafer to the wafer cassette. However, when the wafer is reversed, impurities in the air may adhere to the wafer. Moreover, since the wafers are repeatedly reversed, an overall processing time is increased.

SUMMARY OF THE INVENTION

According to embodiment, there is provided a method and an apparatus which can efficiently polish an entirety of a back surface, including an outermost area thereof, of a substrate while the back surface of the substrate faces downward. According to an embodiment, there is provided a method which can efficiently process an entirety of a back surface, including an outermost area thereof, of a substrate while the back surface of the substrate faces downward.

Embodiments, which will be described below, relate to a method and an apparatus for polishing a substrate, such as a wafer, and a method for processing a substrate.

In an embodiment, there is provided a polishing method comprising: rotating a substrate by rotating a plurality of rollers about their respective own axes while the rollers contact a periphery of the substrate with a back surface of the substrate facing downward; and polishing an entirety of the back surface of the substrate by moving a polishing tool relative to the substrate while supplying a liquid onto the back surface of the substrate and while placing the polishing tool in contact with the back surface of the substrate, the polishing tool being located at a lower side of the substrate.

In an embodiment, said moving the polishing tool relative to the substrate comprises moving the polishing tool between a center and an outermost end of the back surface of the substrate while causing the polishing tool to perform a circular motion.

In an embodiment, said moving the polishing tool relative to the substrate comprises moving the polishing tool between a center and an outermost end of the back surface of the substrate while causing the polishing tool to reciprocate in directions parallel to the back surface of the substrate.

In an embodiment, said causing the polishing tool to reciprocate comprises causing the polishing tool to oscillate in directions parallel to the back surface of the substrate.

In an embodiment, the liquid is pure water or an alkaline liquid chemical.

In an embodiment, the polishing tool is a polishing tape having abrasive grains on a surface thereof.

In an embodiment, there is provided a substrate processing method comprising: transporting a substrate from a loading and unloading section to a polishing unit; polishing an entirety of a back surface of the substrate by the polishing unit; cleaning the polished substrate by a cleaning unit; drying the cleaned substrate by a drying unit; and transporting the dried substrate to the loading and unloading section, wherein transporting of the substrate to the polishing unit, polishing of the entirety of the back surface of the substrate, cleaning of the polished substrate, drying of the cleaned substrate, and transporting of the dried substrate to the loading and unloading section are performed with the back surface of the substrate facing downward, and wherein polishing of the entirety of the back surface of the substrate by the polishing unit comprises: rotating the substrate by rotating a plurality of rollers about their respective own axes while the rollers contact a periphery of the substrate with the back surface of the substrate facing downward; and polishing the entirety of the back surface of the substrate by moving a polishing tool relative to the substrate while supplying a liquid onto the back surface of the substrate and while placing the polishing tool in contact with the back surface of the substrate, the polishing tool being located at a lower side of the substrate.

In an embodiment, there is provided a method of polishing a back surface of a substrate comprising: holding a center-side area of the back surface of the substrate by a first substrate holder; polishing a circumference-side area of the back surface by causing a polishing tool to perform a circular motion or oscillate while placing the polishing tool in contact with the circumference-side area of the back surface of the substrate, the polishing tool being located at a lower side of the substrate; holding the circumference-side area of the back surface of the substrate by a second substrate holder; and polishing the center-side area of the back surface by causing the polishing tool to perform a circular motion or oscillate while placing the polishing tool in contact with the center-side area of the back surface of the substrate, the polishing tool being located at the lower side of the substrate.

In an embodiment, there is provided a polishing apparatus comprising: a substrate holder configured to hold a substrate and rotate the substrate; a polishing head configured to bring a polishing tool into contact with a back surface of the substrate; and a polishing-head actuator configured to move the polishing head relative to the substrate when the substrate is held by the substrate holder, wherein the substrate holder comprises a plurality of rollers, the rollers are rotatable about their respective own axes, the rollers have substrate holding surfaces which can contact a periphery of the substrate, and the polishing head is disposed below the substrate holding surfaces, and faces upward.

In an embodiment, the polishing-head actuator comprises a polishing-head driving mechanism configured to cause the polishing head to perform a circular motion or oscillate.

In an embodiment, the polishing-head actuator further comprises a polishing-head moving mechanism configured to translate the polishing head.

In an embodiment, the polishing tool is a polishing tape having abrasive grains on a surface thereof.

In an embodiment, there is provided a polishing apparatus comprising: a first substrate holder configured to hold a center-side area of a back surface of a substrate and to rotate the substrate; a second substrate holder configured to hold a circumference-side area of the back surface; a polishing head configured to polish the back surface of the substrate by bringing a polishing tool into contact with the back surface of the substrate; and a polishing-head actuator configured to move the polishing head relative to the substrate when the substrate is held by the first substrate holder or the second substrate holder, the polishing-head actuator including a polishing-head driving mechanism configured to cause the polishing head to perform a circular motion or oscillate.

According to the above-described embodiments, when the polishing head is polishing the back surface of the substrate, each of the rollers, holding the periphery of the substrate, rotates about the axis of each roller, while positions of the rollers themselves are stationary. Therefore, the rollers do not contact the polishing head, and the polishing tool can polish the entirety of the back surface, including the outetillost area thereof, of the substrate. As a result, there is no need to polish the outermost area of the back surface of the substrate with use of an edge polishing apparatus, and hence the number of polishing steps can be reduced.

According to the above-described embodiments, the polishing tool is disposed at the lower side of the substrate, and is moved relative to the substrate. Therefore, the polishing tool can efficiently polish the entirety of the back surface of the substrate that faces downward. As a result, there is no need to reverse the substrate in order to polish the back surface. Accordingly, adhesion of impurities in the air to the substrate can be prevented, and the overall processing time can be reduced.

DESCRIPTION OF EMBODIMENTS

Figure 1:
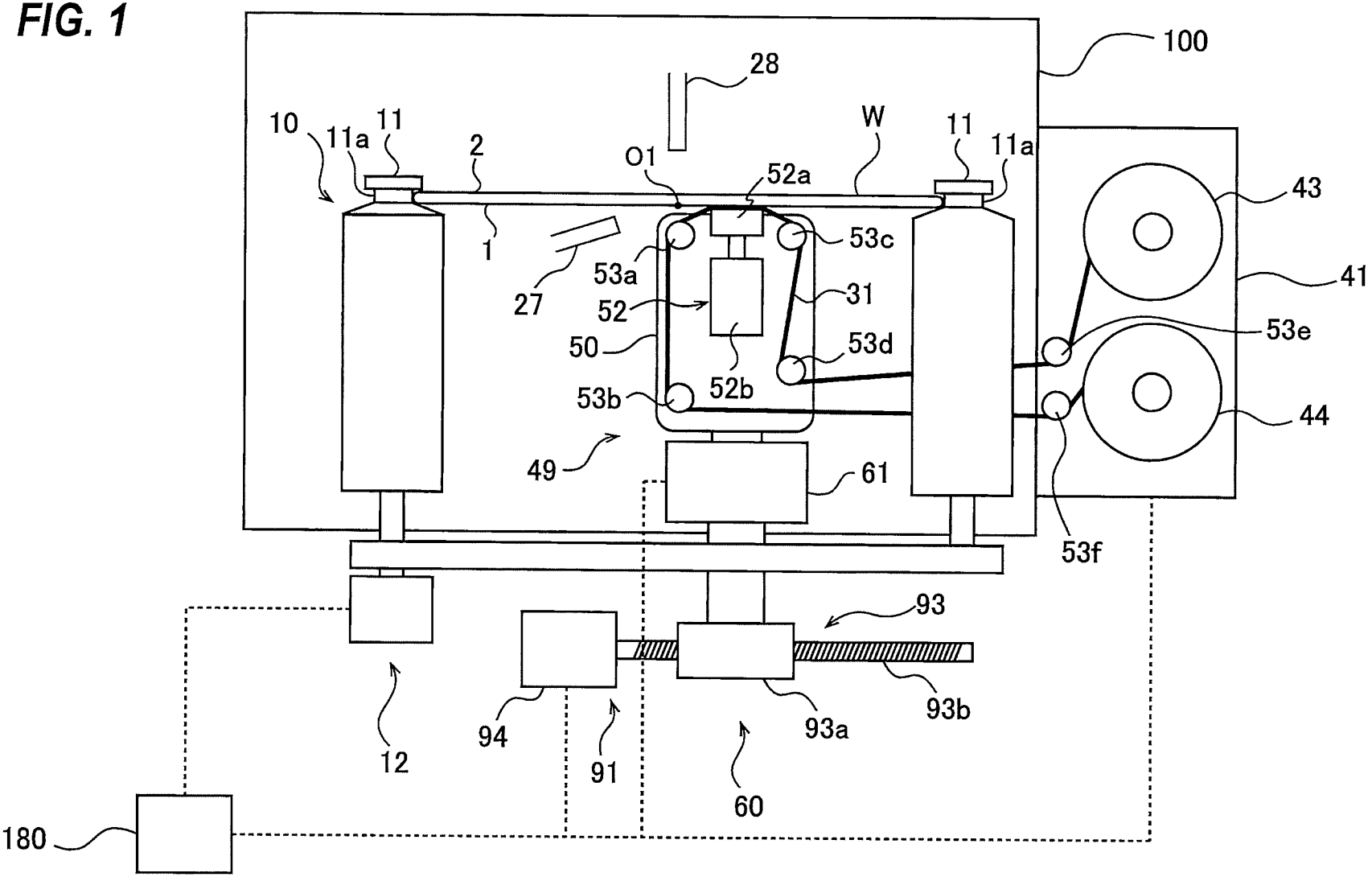
FIG. 1 is a schematic view showing an embodiment of a polishing apparatus.

Embodiments will now be described with reference to the drawings. FIG. 1 is a schematic view showing an embodiment of a polishing apparatus. The polishing apparatus shown in FIG. 1 includes a substrate holder 10 for holding a wafer W, which is an example of a substrate, and rotating the wafer W about its axis, and a polishing head assembly 49 for polishing a first surface 1 of the wafer W, held by the substrate holder 10, to remove foreign matter, scratches, etc. from the first surface 1 of the wafer W. The polishing head assembly 49 is disposed at a lower side of the wafer W held by the substrate holder 10.

In this embodiment, the first surface 1 of the wafer W is a back surface of the wafer W with no device formed thereon, i.e., a non-device surface, while an opposite second surface 2 of the wafer W is a surface on which devices are formed, i.e., a device surface. In this embodiment, the wafer W is held by the substrate holder 10 horizontally with the first surface 1 facing downward.

The substrate holder 10 includes a plurality of rollers 11 which can contact a periphery of the wafer W, and a roller-rotating mechanism 12 for rotating the rollers 11 about their respective own axes. In this embodiment, four rollers 11 are provided. In one embodiment, five or more rollers 11 may be provided. In one embodiment, the roller-rotating mechanism 12 includes motors, belts, and pulleys. The roller-rotating mechanism 12 is configured to rotate the four rollers 11 in the same direction at the same speed. During polishing of the first surface 1 of the wafer W, the periphery of the wafer W is held by the rollers 11. The wafer W is held horizontally, and is rotated about its axis by the rotations of the rollers 11. During polishing of the first surface 1 of the wafer W, the four rollers 11 rotate about their respective own axes, while positions of the rollers 11 themselves are stationary.

Figure 2:
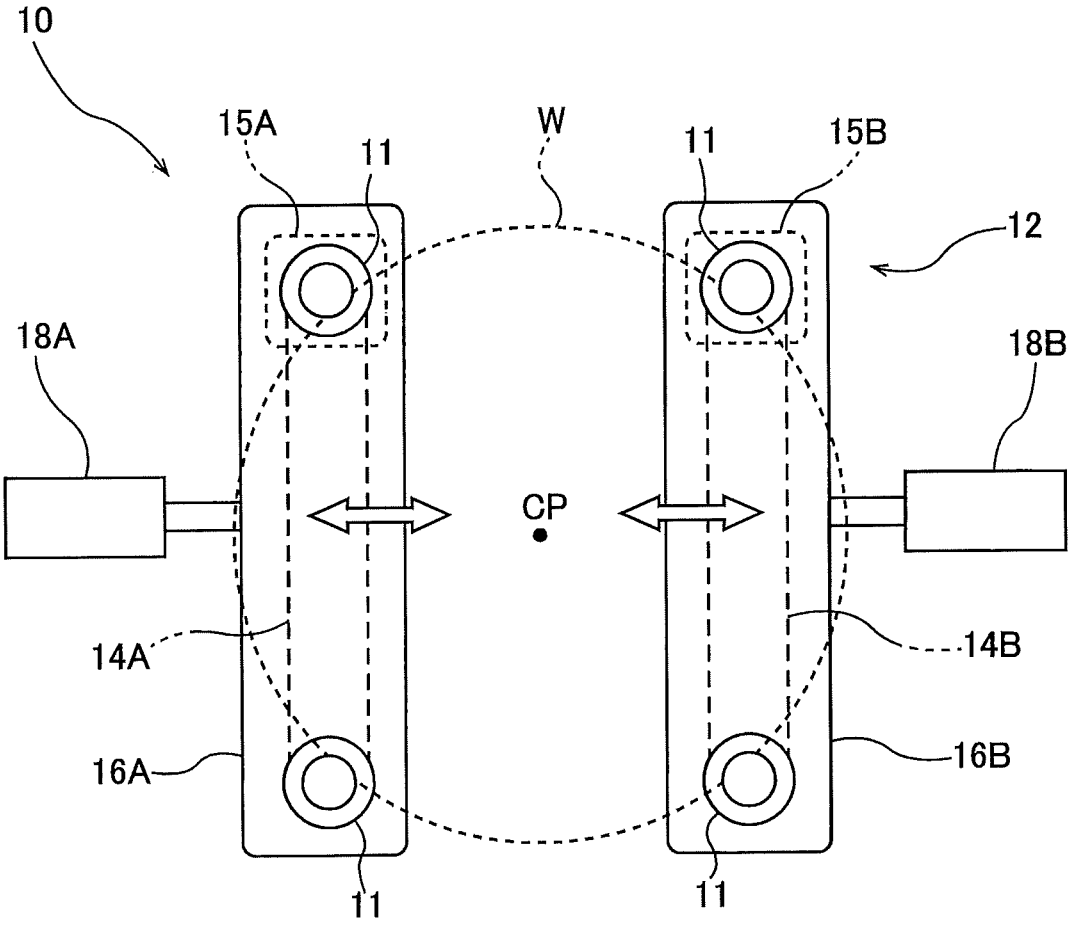
FIG. 2 is a plan view showing details of a roller-rotating mechanism.

FIG. 2 is a plan view showing details of the roller-rotating mechanism 12. The roller-rotating mechanism 12 includes a first belt 14A coupling two of the four rollers 11, a first motor 15A coupled to one of the two rollers 11 coupled by the first belt 14A, a first roller base 16A that rotatably supports the two rollers 11 coupled by the first belt 14A, a second belt 14B coupling the other two of the four rollers 11, a second motor 15B coupled to one of the two rollers 11 coupled by the second belt 14B, and a second roller base 16B that rotatably supports the two rollers 11 coupled by the second belt 14B.

The first motor 15A and the first belt 14A are disposed below the first roller base 16A, and the second motor 15B and the second belt 14B are disposed below the second roller base 16B. The first motor 15A and the second motor 15B are secured to a lower surface of the first roller base 16A and a lower surface of the second roller base 16B, respectively. Not-shown pulleys are secured to lower portions of the four rollers 11, respectively. The first belt 14A rides on pulleys secured to two of the four rollers 11, and the second belt 14B rides on pulleys secured to the other two rollers 11. The first motor 15A and the second motor 15B are configured to rotate at the same speed in the same direction. Therefore, the four rollers 11 can rotate at the same speed in the same direction.

The roller-rotating mechanism 12 further includes a first actuator 18A coupled to the first roller base 16A, and a second actuator 18B coupled to the second roller base 16B. The first actuator 18A is configured to move the two rollers 11, supported by the first roller base 16A, in horizontal directions as shown by arrow. Similarly, the second actuator 18B is configured to move the other two rollers 11, supported by the second roller base 16B, in horizontal directions as shown by arrow. Specifically, the first actuator 18A and the second actuator 18B are configured to move the two pairs of rollers 11 (each pair comprising two rollers 11 in this embodiment) in directions closer to and away from each other. The first actuator 18A and the second actuator 18B may each be comprised of an air cylinder, a motor-driven actuator, or the like. In the embodiment shown in FIG. 2, the first actuator 18A and the second actuator 18B are each comprised of an air cylinder. When the two pairs of rollers 11 move closer to each other, the wafer W is held by the four rollers 11. When the two pairs of rollers 11 move away from each other, the wafer W is released from the four rollers 11. In this embodiment, the four rollers 11 are arranged around an axis CP of the substrate holder 10. It is noted that the number of rollers 11 is not limited to four. For example, it is possible to arrange three rollers 11 around the axis CP at regular angular intervals of 120 degrees, and to provide an actuator for each one of the rollers 11.

Figure 3:
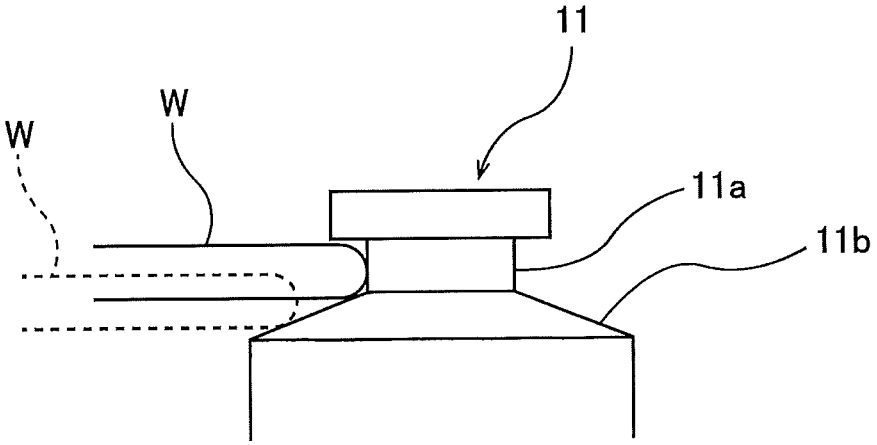
FIG. 3 is an enlarged view of an upper portion of a roller.

FIG. 3 is an enlarged view of an upper portion of the roller 11. Each roller 11 has a cylindrical substrate holding surface 11*a*, and a tapered surface 11*b* connected to the substrate holding surface 11*a* and inclined downwardly from the substrate holding surface 11*a*. The tapered surface 11*b* has a shape of a truncated cone, and has a larger diameter than that of the substrate holding surface 11*a*. The wafer W is first placed on the tapered surfaces 11*b* of the rollers 11 by a not-shown transport device. Subsequently, the rollers 11 move toward the wafer W, until the periphery of the wafer W is held by the substrate holding surfaces 11*a*. When the wafer W is to be released from the rollers 11, the rollers 11 move away from the wafer W, whereby the periphery of the wafer W is separated from the substrate holding surfaces 11*a* and is supported on the tapered surfaces 11*b* (see the dotted line of FIG. 3). The not-shown transport device can remove the wafer W from the tapered surfaces 11*b*.

Figure 4:
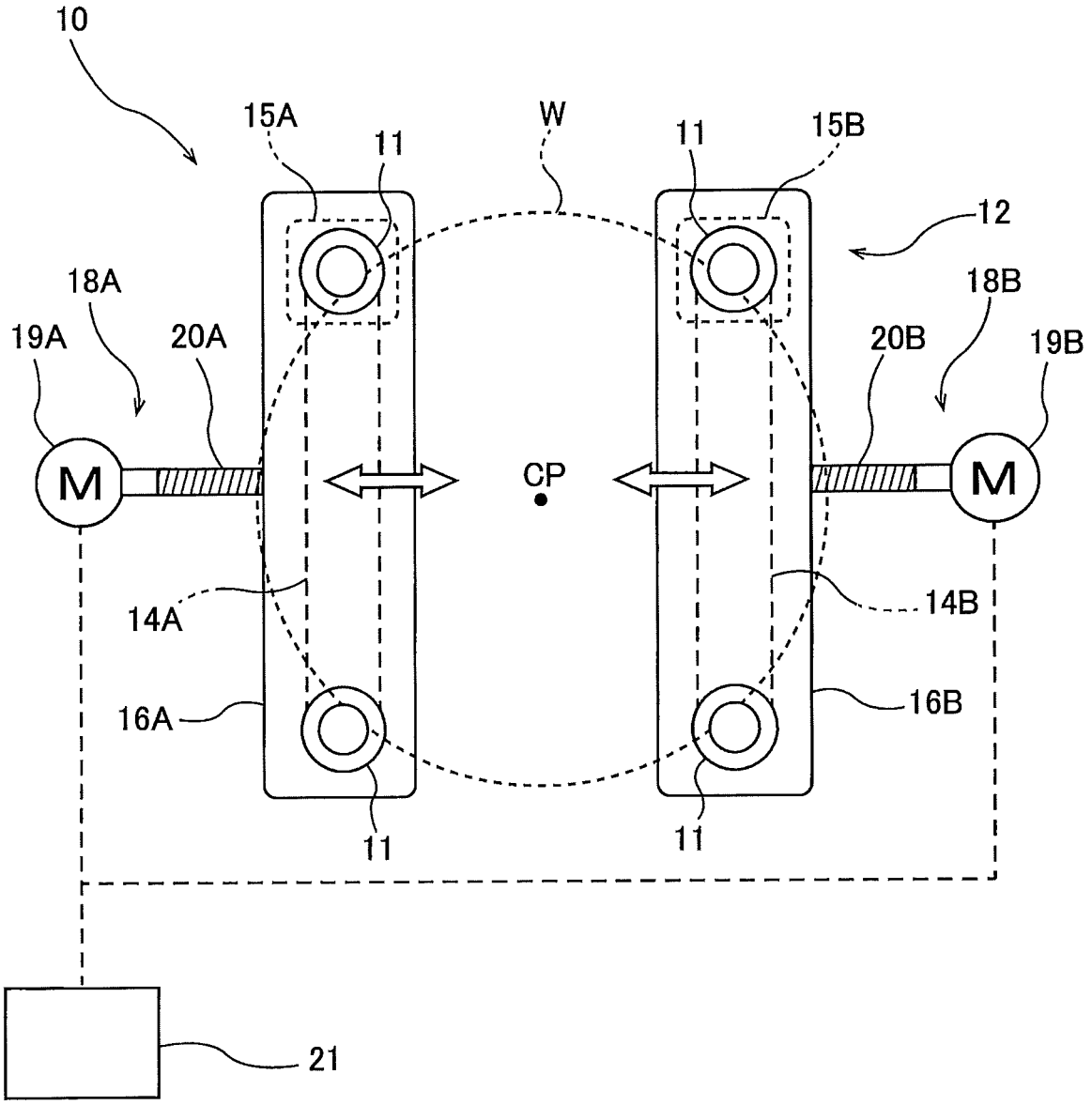
FIG. 4 is a diagram showing an embodiment in which a first actuator and a second actuator are each comprised of a motor-driven actuator.

FIG. 4 is a diagram showing an embodiment in which the first actuator 18A and the second actuator 18B are each comprised of a motor-driven actuator. The first actuator 18A includes a first servo motor 19A, and a first ball screw mechanism 20A coupled to the first roller base 16A. The second actuator 18B includes a second servo motor 19B, and a second ball screw mechanism 20B coupled to the second roller base 16B. The servo motors 19A, 19B are coupled to the ball screw mechanisms 20A, 20B, respectively. When the servo motors 19A, 19B drive the ball screw mechanisms 20A, 20B, the two pairs of rollers 11 move in directions closer to and away from each other.

The servo motors 19A, 19B are electrically connected to an actuator controller 21. By controlling the operations of the servo motors 19A, 19B, the actuator controller 21 can precisely control the positions of the rollers 11 when polishing of the wafer W is performed. In this embodiment, the four rollers 11 are arranged around the axis CP of the substrate holder 10; however, the number of rollers 11 is not limited to four. For example, it is possible to arrange three rollers 11 around the axis CP at regular angular intervals of 120 degrees, and to provide an actuator for each one of the rollers 11.

Referring back to FIG. 1, the polishing head assembly 49 includes a polishing head 50 configured to bring a polishing tape 31, serving as a polishing tool, into contact with the first surface 1 of the wafer W, held by the substrate holder 10, to polish the first surface 1 of the wafer W, and a polishing-head actuator 60 configured to move the polishing head 50 relative to the wafer W. The polishing head 50 is disposed below the substrate holding surface 11*a* of the roller 11, and faces upward. The polishing-head actuator 60 includes a polishing-head driving mechanism 61 configured to cause the polishing head 50 to perform a circular motion or reciprocate, and a polishing-head moving mechanism 91 configured to translate the polishing head 50.

Figure 5:
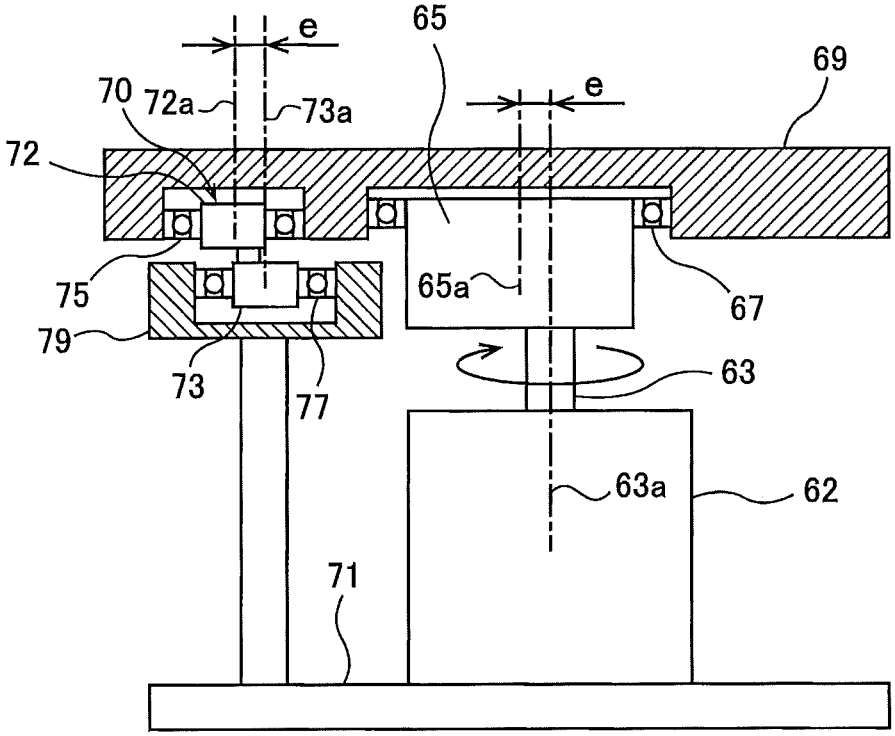
FIG. 5 is a schematic view showing an embodiment of a polishing-head driving mechanism for causing a polishing head to perform a circular motion.

FIG. 5 is a schematic view showing an embodiment of the polishing-head driving mechanism 61 for causing the polishing head 50 to perform a circular motion. The polishing-head driving mechanism 61 shown in FIG. 5 includes a motor 62, an eccentric rotation body 65 secured to a rotating shaft 63 of the motor 62, a table 69 coupled to the eccentric rotation body 65 through a bearing 67, and a plurality of cranks 70 supporting the table 69. Although only one crank 70 is illustrated in FIG. 5, at least three cranks 70 are arranged around the eccentric rotation body 65. The motor 62 is secured to a mount base 71.

An axis 65*a* of the eccentric rotation body 65 is located away from an axis 63*a* of the rotating shaft 63 of the motor 62 by a distance "e". Accordingly, when the motor 62 is in motion, the eccentric rotation body 65 performs a circular motion with the radius "e". Each crank 70 has a first shaft member 72 and a second shaft member 73 secured to each other. An axis 72*a* of the first shaft member 72 and an axis 73*a* of the second shaft member 73 are also located away from each other by the distance "e". The first shaft member 72 is rotatably supported by a bearing 75 held by the table 69, and the second shaft member 73 is rotatably supported by a bearing 77. The bearing 77 is secured to a supporting member 79 secured to the mount base 71.

According to the above-described configuration, when the motor 62 rotates, the eccentric rotation body 65 performs a circular motion with the radius "e", and the table 69 coupled to the eccentric rotation body 65 through the bearing 67 also performs a circular motion with the radius "e". In this specification, a circular motion is defined as a motion in which an object moves in a circular orbit. The circular motion in this embodiment is a circular motion in a plane which is parallel to the first surface 1 of the wafer W. Specifically, directions of movements of the polishing head 50 and the polishing tape 31 when performing the circular motion are parallel to the first surface 1 of the wafer W.

Since the table 69 is supported by the cranks 70, the table 69 itself does not turn around when the table 69 is performing the circular motion. Such motion of the table 69 may be referred to as a translational rotary motion. In this specification, a motion in which an object moves in a circular orbit without rotation of the object itself is defined as the translational rotary motion. This translational rotary motion is one specific example of the circular motion. The polishing head 50 is secured to the table 69. Accordingly, the polishing head 50 performs a circular motion (or translational rotary motion) together with the table 69. In this embodiment, the polishing-head driving mechanism 61 is a translational rotary motion mechanism for causing the polishing head 50 to perform a translational rotary motion.

Figure 6:
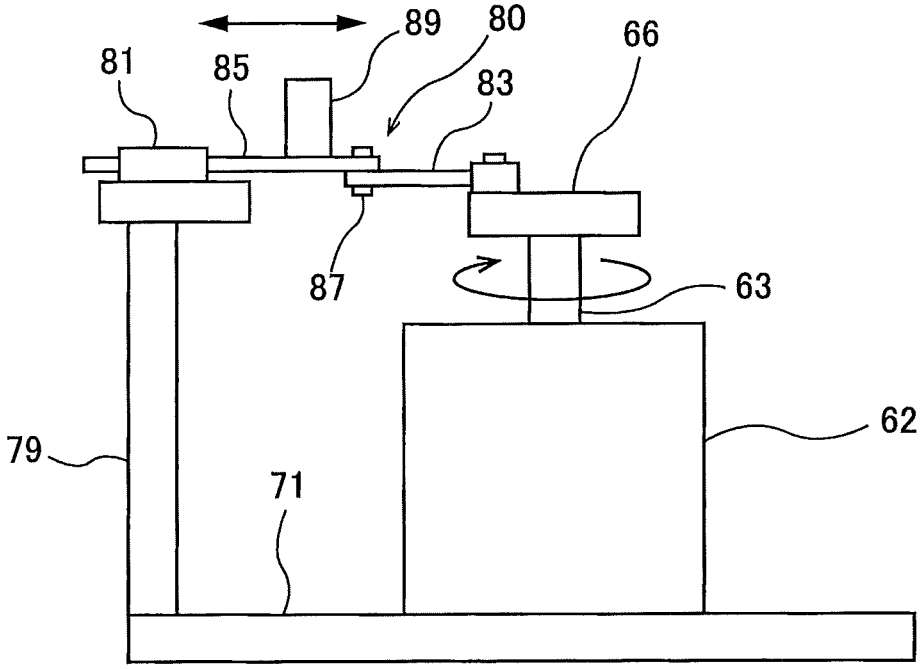
FIG. 6 is a schematic view showing an embodiment of a polishing-head driving mechanism for causing the polishing head to oscillate.

FIG. 6 is a schematic view showing an embodiment of the polishing-head driving mechanism 61 for causing the polishing head 50 to oscillate (or reciprocate) in directions parallel to the first surface 1 of the wafer W. The polishing-head driving mechanism 61 shown in FIG. 6 includes a motor 62, a crank 66 secured to a rotating shaft 63 of the motor 62, a linkage 80 coupled to the crank 66, and a linear motion guide 81 supporting the linkage 80. The motor 62 is secured to the mount base 71.

The linkage 80 includes a first link 83 rotatably coupled to the crank 66, a second link 85 supported by the linear motion guide 81, and a joint 87 coupling the first link 83 to the second link 85. The linear motion guide 81 is a device which allows the second link 85 to move only in a linear direction. The linear motion guide 81 is secured to a supporting member 79 which is secured to the mount base 71.

According to the above-described configuration, when the motor 62 is in motion, an end portion of the first link 83 coupled to the crank 66 is caused to perform a circular motion. This circular motion of the end portion of the first link 83 is transmitted to the second link 85, thereby causing the second link 85 to reciprocate linearly. In this manner, the rotation of the crank 66 is converted into a reciprocating motion. A holding member 89 is secured to the second link 85. The polishing head 50 is secured to the holding member 89. Therefore, the polishing head 50 reciprocates together with the second link 85. The second link 85 is disposed horizontally. Therefore, when the wafer W, with its first surface 1 facing downward, is held by the substrate holder 10, the polishing head 50 reciprocates in directions parallel to the first surface 1 of the wafer W. This reciprocating motion of the polishing head 50 is a linear oscillation in directions parallel to the first surface 1 of the wafer W.

Referring back to FIG. 1, the polishing-head moving mechanism 91 includes a ball screw mechanism 93, and a motor 94 for driving the ball screw mechanism 93. The polishing-head driving mechanism 61 is secured to a movable portion 93*a* of the ball screw mechanism 93. The movable portion 93*a* is coupled to a screw shaft 93*b* of the ball screw mechanism 93. When the motor 94 is in motion, the movable portion 93*a* of the ball screw mechanism 93 is moved in a direction parallel to the first surface 1 of the wafer W. As a result, the polishing-head driving mechanism 61 and the polishing head 50 are moved in a direction parallel to the first surface 1 of the wafer W. In one embodiment, the motor 94 may be a servomotor electrically connected to a not-shown motor controller.

The polishing apparatus of this embodiment further includes a partition 100, a polishing-tool supply and collection mechanism 41 for supplying the polishing tape 31 to the polishing head 50 and collecting the polishing tape 31 from the polishing head 50, a liquid supply nozzle 27 for supplying a liquid onto the first surface 1 of the wafer W, and a protective liquid supply nozzle 28 for supplying a protective liquid onto the second surface 2 of the wafer W. The rollers 11, the polishing head 50, the polishing-head driving mechanism 61, the liquid supply nozzle 27, and the protective liquid supply nozzle 28 are disposed inside the partition 100. The roller-rotating mechanism 12, the polishing-head moving mechanism 91, and the polishing-tool supply and collection mechanism 41 are disposed outside the partition 100.

Figure 7:
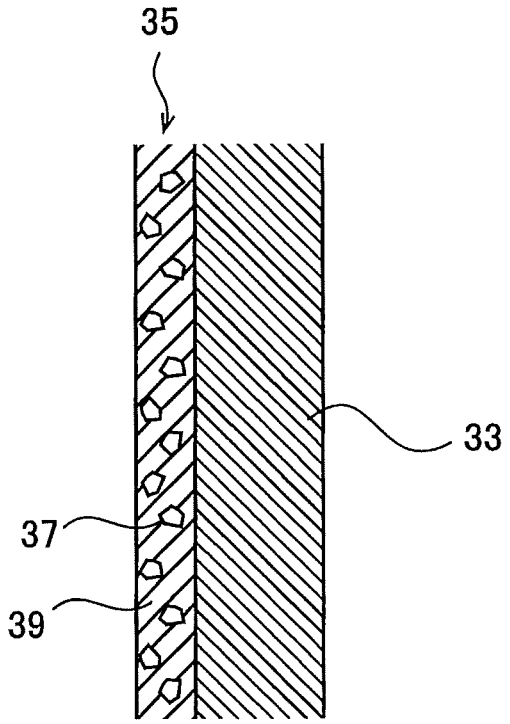
FIG. 7 is a schematic view showing an example of a polishing tape.
Figure 8:
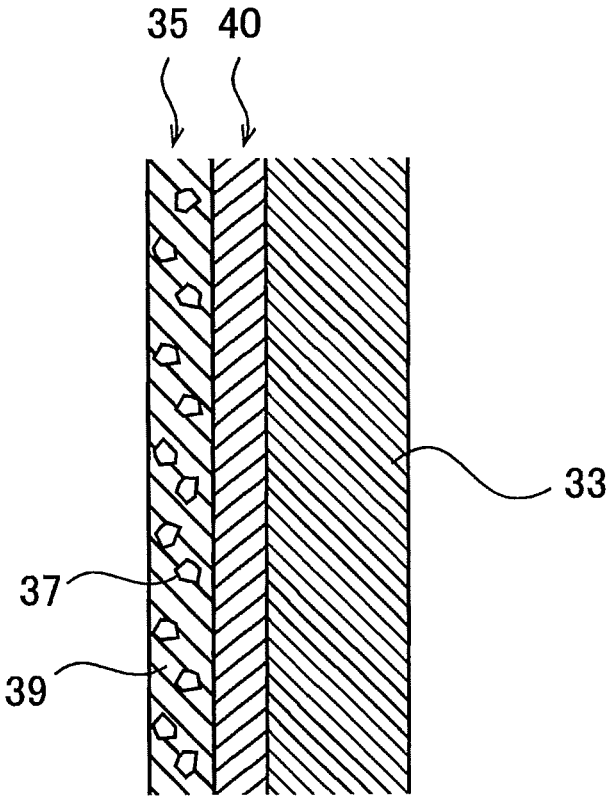
FIG. 8 is a schematic view showing another example of the polishing tape.

In this embodiment, the polishing tape 31 having abrasive grains on a surface thereof is used as a polishing tool. FIG. 7 is a schematic view showing an example of the polishing tape 31. The polishing tape 31 shown in FIG. 7 has a base tape 33 and a polishing layer 35. A surface of the base tape 33 is covered with the polishing layer 35. The polishing layer 35 has abrasive grains 37, and a binder (resin) 39 holding the abrasive grains 37. FIG. 8 is a schematic view showing another example of the polishing tape 31. The polishing tape 31 shown in FIG. 8 has a base tape 33, a polishing layer 35, and an elastic layer 40 which is located between the base tape 33 and the polishing layer 35. The elastic layer 40 is made of a nonwoven fabric made of polypropylene, polyurethane, polyester or nylon, or an elastic material such as silicone rubber. In one embodiment, the polishing tool may be a whetstone instead of the polishing tape 31. In such a case, the polishing-tool supply and collection mechanism 41 may be omitted.

Referring back to FIG. 1, the polishing-tool supply and collection mechanism 41 includes a supply reel 43 for supplying the polishing tape 31 to the polishing head 50, and a collection reel 44 for collecting the polishing tape 31 that has been used in polishing of the wafer W. Tension motors (not shown) are coupled to the supply reel 43 and the collection reel 44, respectively. The respective tension motors are configured to apply a predetermined torque to the supply reel 43 and the collection reel 44 to thereby exert a predetermined tension on the polishing tape 31.

The polishing tape 31 is supplied to the polishing head 50 such that the polishing layer 35 of the polishing tape 31 faces the first surface 1 of the wafer W. The polishing tape 31 is supplied from the supply reel 43 to the polishing head 50 through an opening (not shown) formed in the partition 100, and the polishing tape 31 that has been used is collected by the collection reel 44 through the opening.

The polishing head 50 includes a pressing mechanism 52 for pressing the polishing tape 31 against the first surface 1 of the wafer W. The polishing tape 31 is supplied so as to pass on an upper surface of the pressing mechanism 52. In this embodiment, the pressing mechanism 52 includes a pressing pad 52*a* for supporting a back surface of the polishing tape 31, and an air cylinder 52*b* coupled to the pressing pad 52*a*.

The pressing mechanism 52 presses the polishing tape 31 from below, and brings a polishing surface constituted by a surface of the polishing layer 35 into contact with the first surface 1 of the wafer W to thereby polish the first surface 1 of the wafer W. The polishing head 50 further includes a plurality of guide rollers 53*a*, 53*b*, 53*c*, 53*d*. The polishing-tool supply and collection mechanism 41 further includes a plurality of guide rollers 53*e*, 53*f*. The guide rollers 53*a*, 53*c*, disposed at an upper portion of the polishing head 50, are arranged to guide the polishing tape 31 such that the polishing tape 31 is advanced in a direction parallel to the first surface 1 of the wafer W.

The liquid supply nozzle 27 is disposed below the wafer W held by the substrate holder 10. The liquid supply nozzle 27 is coupled to a not-shown liquid supply source. The liquid supply nozzle 27 is oriented toward a center O1 of the first surface 1 of the wafer W, and is oriented in a radially outward direction of the wafer W. The liquid is supplied onto the first surface 1 of the wafer W from the liquid supply nozzle 27. The wafer W is polished in the presence of the liquid. The liquid flows radially outwardly on the first surface 1 of the wafer W, so that polishing debris can be removed from the first surface 1 of the wafer W. In this embodiment, the above-described liquid is pure water. In one embodiment, the liquid may be an alkaline liquid chemical having etching action.

The protective liquid supply nozzle 28 is disposed above the substrate holder 10. The protective liquid supply nozzle 28 is coupled to a not-shown protective liquid supply source. The protective liquid supply nozzle 28 is oriented toward a center of the second surface 2 of the wafer W, so that the protective liquid is supplied onto the second surface 2 of the wafer W. The protective liquid that has been supplied to the second surface 2 of the wafer W spreads over an entirety of the second surface 2 of the wafer W by the centrifugal force, and protects the second surface 2 of the wafer W. The above-described protective liquid prevents a liquid, containing polishing debris, foreign matter, etc. produced in polishing of the wafer W, from reaching and contacting the second surface 2 of the wafer W. As a result, the second surface 2 of the wafer W can be kept clean. In this embodiment, the above-described protective liquid is pure water.

The polishing apparatus of this embodiment includes the single polishing head assembly 49 and the single polishing-tool supply and collection mechanism 41. In one embodiment, the polishing apparatus may include two or more polishing head assemblies 49 and two or more polishing-tool supply and collection mechanisms 41. In one embodiment, the polishing apparatus may include two or more liquid supply nozzles 27. Operation of the polishing apparatus of this embodiment will now be described.

The operation of the polishing apparatus described below is controlled by an operation controller 180 shown in FIG. 1. The operation controller 180 is electrically connected to the substrate holder 10, the polishing head assembly 49, and the polishing-tool supply and collection mechanism 41. Operations of the substrate holder 10, the liquid supply nozzle 27, the protective liquid supply nozzle 28, the polishing head assembly 49, and the polishing-tool supply and collection mechanism 41 are controlled by the operation controller 180. The operation controller 180 is constituted by a dedicated computer or a general-purpose computer.

The wafer W to be polished is held by the rollers 11 of the substrate holder 10 with the first surface 1 facing downward, and is then rotated about the axis of the wafer W. Subsequently, the liquid is supplied from the liquid supply nozzle 27 onto the first surface 1 of the wafer W, and the protective liquid is supplied from the protective liquid supply nozzle 28 onto the second surface 2 of the wafer W. The liquid that has been supplied to the first surface 1 of the wafer W flows radially outwardly on the first surface 1 of the wafer W, and the protective liquid that has been supplied to the second surface 2 of the wafer W spreads over the entirety of the second surface 2 of the wafer W by the centrifugal force.

The polishing tape 31 is supplied in advance to the polishing head 50. The operation controller 180 operates the polishing-tool supply and collection mechanism 41 to advance the polishing tape 31 in a direction parallel to the first surface 1 of the wafer W while the polishing-tool supply and collection mechanism 41 exerts a predetermined tension on the polishing tape 31. The polishing head 50 and the polishing tape 31 are moved relative to the wafer W, while the liquid is supplied onto the first surface 1 of the wafer W and while the polishing tape 31 is placed in contact with the first surface 1 of the wafer W, to thereby polish the first surface 1 of the wafer W. Specifically, the polishing-head moving mechanism 91 moves the polishing head 50 and the polishing tape 31 between the center O1 and an outermost end of the first surface 1 of the wafer W, while the polishing-head driving mechanism 61 causes the polishing head 50 and the polishing tape 31 to perform a circular motion, or to reciprocate (oscillate) in directions parallel to the first surface 1 of the wafer W.

Figure 9:
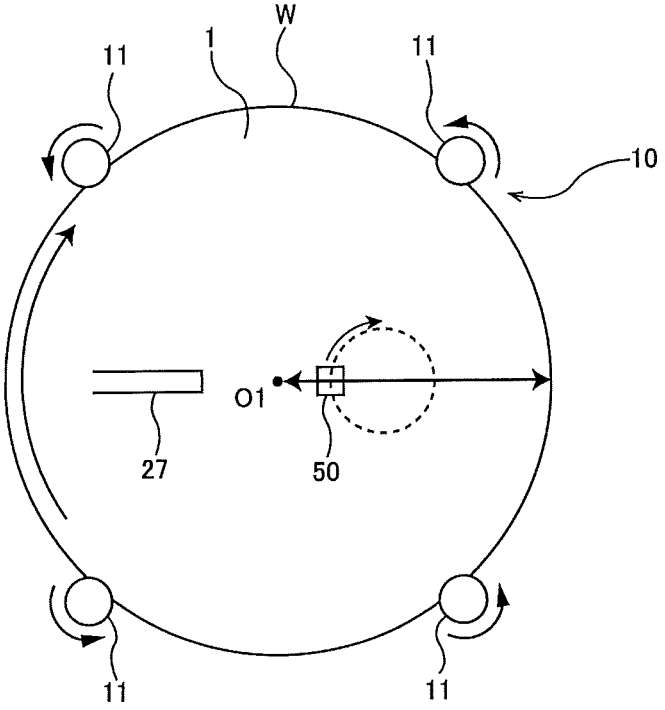
FIG. 9 is a schematic view illustrating an operation of the polishing head when polishing a first surface of the wafer while the polishing head is performing a circular motion, as viewed from below the wafer.
Figure 10:
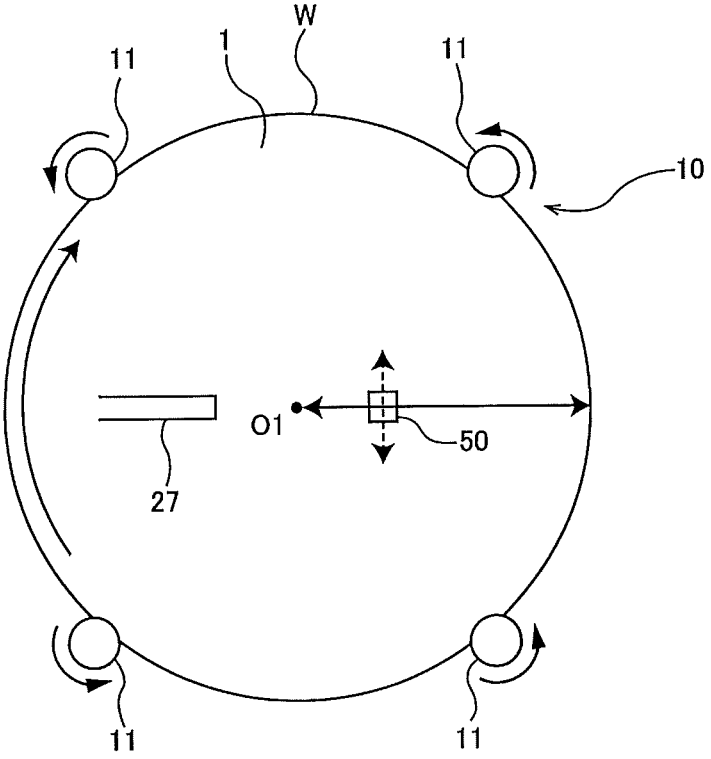
FIG. 10 is a schematic view illustrating an operation of the polishing head when polishing a first surface of the wafer while the polishing head is reciprocating, as viewed from below the wafer.

FIG. 9 is a schematic view illustrating the operation of the polishing head 50 when polishing the first surface 1 of the wafer W while the polishing head 50 is performing a circular motion, as viewed from below the wafer W. FIG. 10 is a schematic view illustrating the operation of the polishing head 50 when polishing the first surface 1 of the wafer W while the polishing head 50 is reciprocating, as viewed from below the wafer W. The polishing head 50, while performing a circular motion or reciprocating as indicated by a dotted line, polishes the entirety of the first surface 1 of the rotating wafer W.

In FIG. 10, the direction (hereinafter referred to first direction) in which the polishing head 50 reciprocates with the actuation of the polishing-head driving mechanism 61 is perpendicular to the direction (hereinafter referred to second direction) in which the polishing head 50 is moved by the polishing-head moving mechanism 91. The present invention, however, is not limited to this embodiment, and the first direction may not be perpendicular to the second direction. After a preset time has elapsed or after the polishing head 50 has been moved between the center O1 and the outermost end of the first surface 1 a preset number of times, the operation controller 180 stops the respective operations of the substrate holder 10, the liquid supply nozzle 27, the protective liquid supply nozzle 28, the polishing head assembly 49, and the polishing-tool supply and collection mechanism 41, so that the polishing operation is terminated.

As described above, when the polishing head 50 is polishing the first surface 1 of the wafer W, the rollers 11, holding the periphery of the wafer W, rotate about the respective axes of the rollers 11, while the positions of the rollers 11 themselves are stationary. Accordingly, the rollers 11 do not contact the polishing head 50, and the polishing tape 31 can polish the entirety of the first surface 1, including its outermost area, of the wafer W. As a result, there is no need to polish the outermost area of the first surface 1 of the wafer W with use of an edge polishing apparatus, and an overall polishing time can be reduced.

When the first surface 1, facing downward, of the wafer W is being polished, the liquid that has been supplied to the first surface 1 of the wafer W flows downwardly. Thus, the polishing head assembly 49 and its neighboring mechanisms each have a waterproof structure (not shown). In this embodiment, since the motion of the polishing head 50 is the circular motion, the reciprocating motion, or the translational motion, problems such as a twist of the polishing tape 31 do not occur. Moreover, the polishing head 50 can be driven independently from the polishing-tape supply and collection mechanism 41. Accordingly, the polishing-tool supply and collection mechanism 41 can be disposed outside the partition 100, and the above-described waterproof structures can also be made simple.

Figure 11:
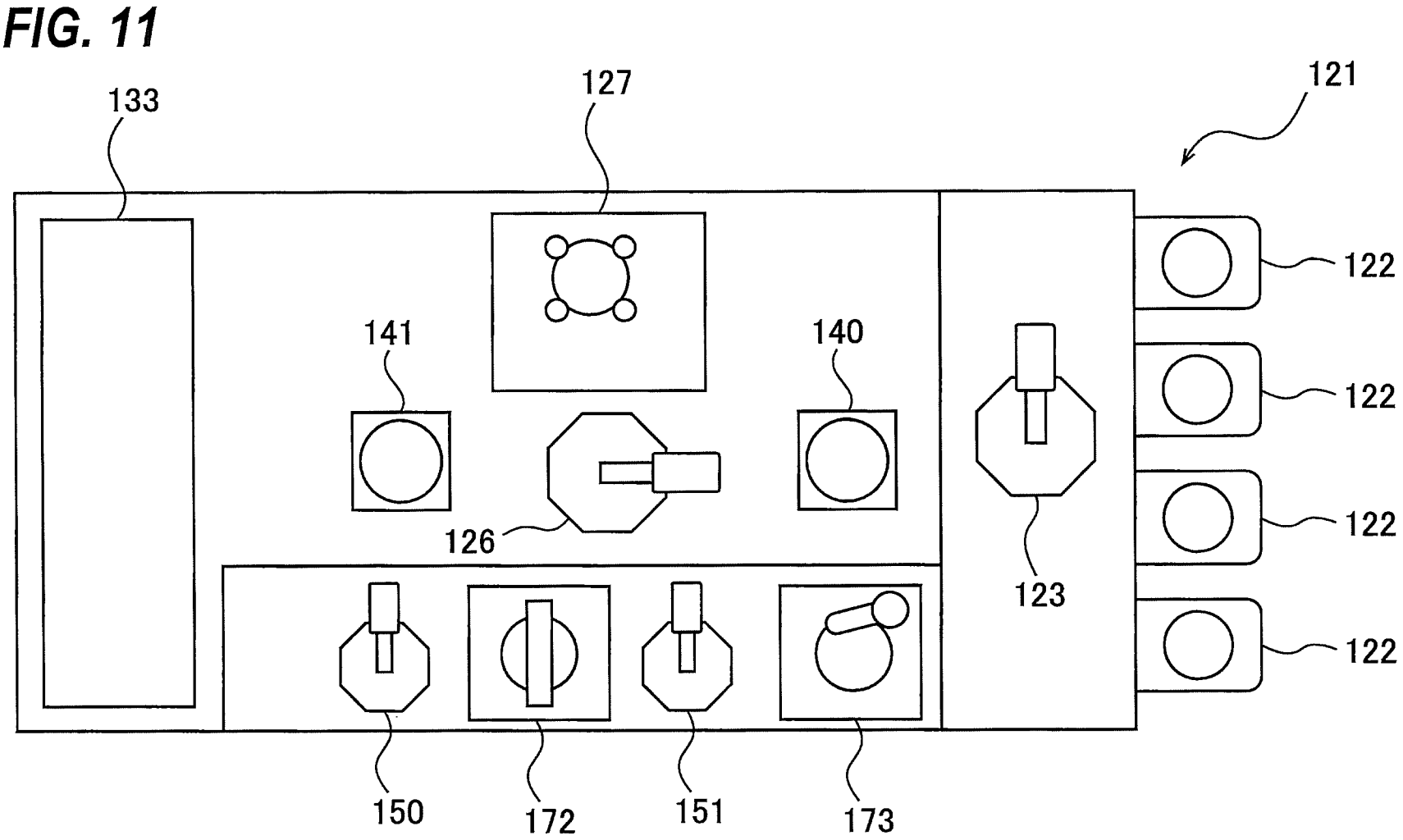
FIG. 11 is a plan view schematically showing an embodiment of a substrate processing system including the polishing apparatus.

FIG. 11 is a plan view schematically showing an embodiment of a substrate processing system including the above-described polishing apparatus. In this embodiment, the substrate processing system includes a loading and unloading section 121 including a plurality of loading ports 122 on which wafer cassettes (substrate cassettes), each storing a large number of wafers therein, are placed. An open cassette, a SMIF (Standard Manufacturing Interface) pod, or a FOUP (Front Opening Unified Pod) can be placed on the loading port 122. The SMIF and the FOUP are each an airtight container which can house the wafer cassette therein and which, by covering it with a partition wall, can keep its internal environment independent from the external environment.

A first transfer robot (loader) 123 is disposed in the loading and unloading section 121. This first transfer robot 123 is movable along an arrangement direction of the loading ports 122. The first transfer robot 123 can access the wafer cassettes mounted on the loading ports 122 and can take a wafer out of the wafer cassettes.

The substrate processing system further includes a second transfer robot 126 which is movable in a horizontal direction, a first temporary placement stage 140 and a second temporary placement stage 141 on which wafers are temporarily placed, a polishing unit 127, a system controller 133 for controlling an overall operations of the substrate processing system, a cleaning unit 172 for cleaning a polished wafer, and a drying unit 173 for drying the cleaned wafer. A third transfer robot 150 for transporting a wafer is disposed between the second temporary placement stage 141 and the cleaning unit 172. A fourth transfer robot 151 for transporting a wafer is disposed between the cleaning unit 172 and the drying unit 173. The polishing unit 127 is the above-described polishing apparatus shown in FIG. 1.

Next, a transport route of a wafer when the wafer is to be polished with use of the polishing unit 127 will now be described. A plurality of wafers (for example, 25 wafers), with their respective device surfaces facing upward, are stored in the wafer cassette (i.e., substrate cassette) on the loading port 122. The first transfer robot 123 removes a wafer from the wafer cassette, and places the wafer on the first temporary placement stage 140. The second transfer robot 126 removes the wafer from the first temporary placement stage 140, and transports the wafer, with its back surface facing downward, to the polishing unit 127. As described previously with reference to FIG. 9 and FIG. 10, the back surface of the wafer is polished by the polishing unit 127. The second transfer robot 126 removes the polished wafer from the polishing unit 127, and places the polished wafer on the second temporary placement stage 141. The third transfer robot 150 removes the wafer from the second temporary placement stage 141, and transports the wafer to the cleaning unit 172.

The wafer, with its polished back surface facing downward, is cleaned by the cleaning unit 172. In one embodiment, the cleaning unit 172 includes an upper roll sponge and a lower roll sponge disposed such that the wafer is sandwiched between these two roll sponges, and is configured to clean both surfaces of the wafer with the roll sponges while supplying a cleaning liquid onto the both surfaces of the wafer.

The fourth transfer robot 151 removes the cleaned wafer from the cleaning unit 172, and transports the cleaned wafer to the drying unit 173. The wafer, with its cleaned back surface facing downward, is dried by the drying unit 173. In this embodiment, the drying unit 173 is configured to spin-dry the wafer by rotating the wafer about its axis at a high speed. In one embodiment, the drying unit 173 may be an IPA type configured to dry the wafer by supplying pure water and an IPA vapor (a mixture of isopropyl alcohol and $N_2$ gas) from a pure-water nozzle and an IPA nozzle onto an upper surface of the wafer while moving the pure-water nozzle and the IPA nozzle in a radial direction of the wafer.

The dried wafer, with its back surface facing downward, is returned to the wafer cassette on the loading port 122 by the first transfer robot 123. In this manner, the substrate processing system can perform a series of processes including polishing of the wafer, cleaning of the wafer, drying of the wafer, and transporting of the wafer to the loading and unloading section, while the back surface of the wafer is kept facing downward.

According to this embodiment, the entirety of the back surface of the wafer can be efficiently polished with the back surface facing downward. As a result, there is no need to reverse the wafer W for polishing the back surface, and hence adhesion of impurities in the air to the wafer W can be prevented and the overall processing time can be reduced.

Figure 12:
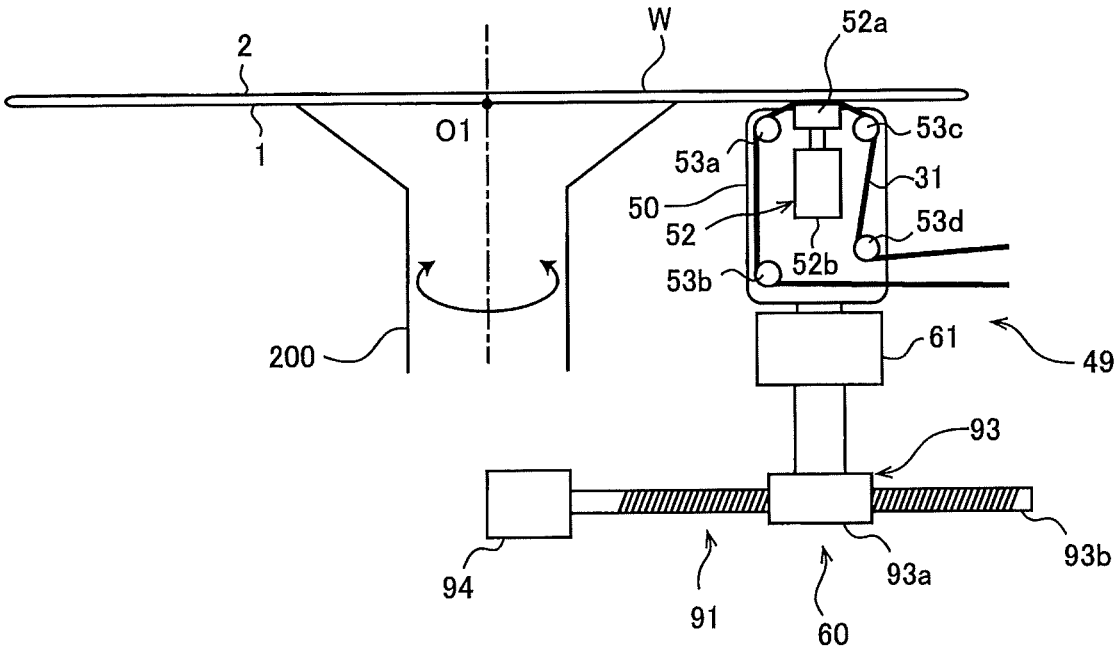
FIG. 12 is a schematic view showing another embodiment of the polishing apparatus.

FIG. 12 is a schematic view showing another embodiment of the polishing apparatus. The construction and the operation of this embodiment, which will not be described particularly, are the same as those of the embodiment described with reference to FIG. 1 and FIG. 5 to FIG. 10, and duplicate descriptions thereof are omitted. The polishing apparatus shown in FIG. 12 includes a first substrate holder 200 instead of the substrate holder 10. The first substrate holder 200 is configured to be rotatable about its axis and movable in a vertical direction.

The wafer W, with its first surface 1 facing downward, is horizontally held by the first substrate holder 200. A center-side area of the wafer W is held on the first substrate holder 200 by vacuum suction or the like, and the wafer W is rotated about the axis of the first substrate holder 200. When the wafer W is being rotated, the polishing head 50 and the polishing tape 31 are caused to perform a circular motion, or to reciprocate (oscillate) in directions parallel to the first surface 1 of the wafer W by the polishing-head driving mechanism 61 of the polishing-head actuator 60, while the polishing tape 31 is in contact with a circumference-side area of the first surface 1 of the wafer W, so that the circumference-side area of the first surface 1 of the wafer W is polished. In one embodiment, the polishing head 50 and the polishing tape 31 may be moved within the circumference-side area of the first surface 1 of the wafer W by the polishing-head moving mechanism 91 of the polishing-head actuator 60 while the polishing head 50 and the polishing tape 31 are performing a circular motion or reciprocating (oscillating).

Figure 13:
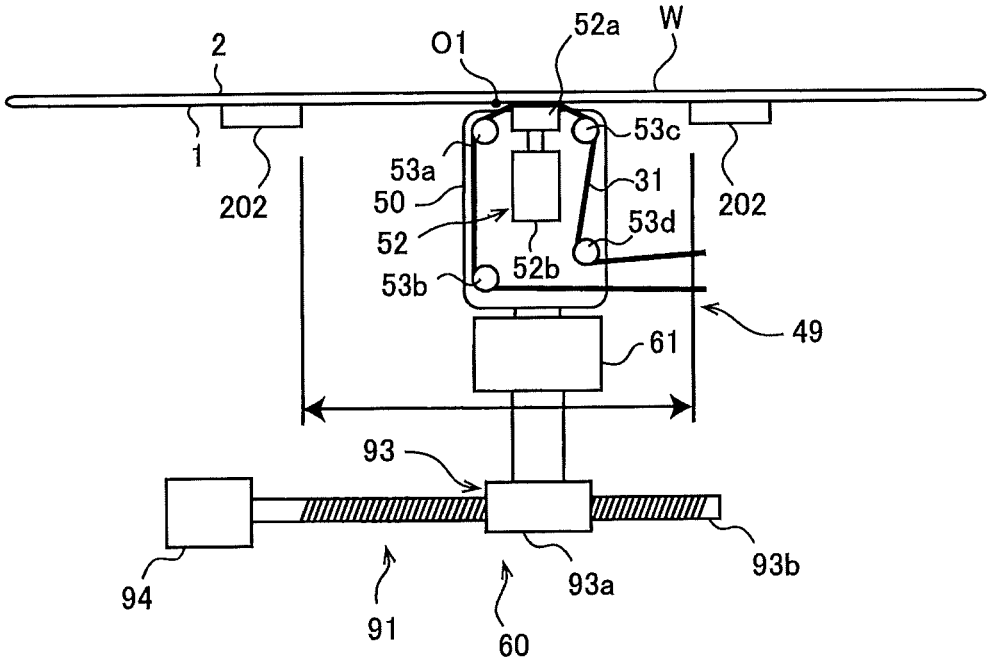
FIG. 13 is a schematic view showing a state in which a circumference-side area of the first surface of the wafer is held by second substrate holders.

The polishing apparatus of this embodiment further includes second substrate holders 202 for holding the circumference-side area of the first surface 1 of the wafer W. FIG. 13 is a schematic view showing a state in which the circumference-side area of the first surface 1 of the wafer W is held by the second substrate holders 202. When the wafer W is held by the second substrate holders 202, the first substrate holder 200 is moved downwardly to a retreat position. The second substrate holders 202 are configured to be movable in a vertical direction and in a horizontal direction. When the wafer W is held by the first substrate holder 200, the second substrate holders 202 are moved horizontally to retreat positions.

The wafer W, with its first surface 1 facing downward, is horizontally held by the second substrate holders 202. The circumference-side area of the first surface 1 of the wafer W is held on the second substrate holders 202 by vacuum suction or the like. When the circumference-side area of the first surface 1 is being held by the second substrate holders 202, the polishing head 50 and the polishing tape 31 are caused to perform a circular motion, or to reciprocate (oscillate) in directions parallel to the first surface 1 of the wafer W by the polishing-head driving mechanism 61 of the polishing-head actuator 60, while the polishing tape 31 is in contact with the center-side area of the first surface 1 of the wafer W, so that the center-side area of the first surface 1 of the wafer W is polished. In one embodiment, the polishing head 50 and the polishing tape 31 may be moved within the center-side area (i.e., an area indicated by arrows shown in FIG. 13) of the first surface 1 of the wafer W by the polishing-head moving mechanism 91 of the polishing-head actuator 60 while the polishing head 50 and the polishing tape 31 are performing a circular motion or reciprocating (oscillating).

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing method comprising:

rotating a substrate by rotating a plurality of rollers about their respective own axes while the rollers contact a periphery of the substrate with a back surface of the substrate facing downward; and polishing an entirety of the back surface of the substrate by moving a polishing tool relative to the substrate without rotating the polishing tool about its axis, while supplying a liquid onto the back surface of the substrate and while placing the polishing tool in contact with the back surface of the substrate by a polishing head, the polishing tool being located at a lower side of the substrate, the polishing head having its central axis perpendicular to the back surface of the substrate.

2. The polishing method according to claim 1, wherein said moving the polishing tool relative to the substrate comprises moving the polishing tool between a center and an outermost end of the back surface of the substrate while causing the polishing tool to perform a translational rotary motion which is a movement of the polishing tool in a circular orbit without rotation of the polishing tool about its axis.

3. The polishing method according to claim 1, wherein said moving the polishing tool relative to the substrate comprises moving the polishing tool between a center and an outermost end of the back surface of the substrate while causing the polishing tool to reciprocate in directions parallel to the back surface of the substrate.

4. The polishing method according to claim 3, wherein said causing the polishing tool to reciprocate comprises causing the polishing tool to oscillate in directions parallel to the back surface of the substrate.

5. The polishing method according to claim 1, wherein the liquid is pure water or an alkaline liquid chemical.

6. The polishing method according to claim 1, wherein the polishing tool is a polishing tape having abrasive grains on a surface thereof.

7. A substrate processing method comprising:

transporting a substrate from a loading and unloading section to a polishing unit;

polishing an entirety of a back surface of the substrate by the polishing unit;

cleaning the polished substrate by a cleaning unit;

drying the cleaned substrate by a drying unit; and transporting the dried substrate to the loading and unloading section, wherein transporting of the substrate to the polishing unit, polishing of the entirety of the back surface of the substrate, cleaning of the polished substrate, drying of the cleaned substrate, and transporting of the dried substrate to the loading and unloading section are performed with the back surface of the substrate facing downward, and wherein polishing of the entirety of the back surface of the substrate by the polishing unit comprises:

rotating the substrate by rotating a plurality of rollers about their respective own axes while the rollers contact a periphery of the substrate with the back surface of the substrate facing downward; and polishing the entirety of the back surface of the substrate by moving a polishing tool relative to the substrate while supplying a liquid onto the back surface of the substrate and while placing the polishing tool in contact with the back surface of the substrate, the polishing tool being located at a lower side of the substrate.

8. A polishing apparatus comprising:

a substrate holder configured to hold a substrate and rotate the substrate;

a polishing head configured to bring a polishing tool into contact with a back surface of the substrate; and a polishing-head actuator configured to move the polishing head relative to the substrate without rotating the polishing tool about its axis when the substrate is held by the substrate holder, wherein the substrate holder comprises a plurality of rollers, the rollers are rotatable about their respective own axes, the rollers have substrate holding surfaces which can contact a periphery of the substrate, the polishing head is disposed below the substrate holding surfaces, and faces upward, and the polishing head has a central axis parallel to the axes of the rollers.

9. The polishing apparatus according to claim 8, wherein the polishing-head actuator comprises a polishing-head driving mechanism configured to cause the polishing head to perform a circular motion or oscillate.

10. The polishing apparatus according to claim 9, wherein the polishing-head actuator further comprises a polishing-head moving mechanism configured to cause the polishing head to perform a translational rotary motion which is a movement of the polishing head in a circular orbit without rotation of the polishing tool about its axis.

11. The polishing apparatus according to claim 10, wherein:

the polishing-head moving mechanism includes a motor, an eccentric rotation body secured to a rotating shaft of the motor, a table coupled to the eccentric rotation body via a first bearing, and a plurality of cranks supporting the table; and an axis of the eccentric rotation body is located away from an axis of the rotating shaft of the motor by a predetermined distance.

12. The polishing apparatus according to claim 11, wherein each of the plurality of cranks includes a first shaft member and a second shaft member secured to each other, and an axis of the first shaft member is located away from an axis of the second shaft member by the predetermined distance.

13. The polishing apparatus according to claim 12, wherein the polishing-head moving mechanism further includes a mount base to which the motor is secured, wherein the first shaft member is rotatably supported by a second bearing held by the table, and the second shaft member is rotatably supported by a third bearing secured to the mount base.

14. The polishing apparatus according to claim 9, wherein the polishing-head driving mechanism includes a motor, a crank secured to a rotating shaft of the motor, a linkage coupled to the crank, and a linear motion guide supporting the linkage.

15. The polishing apparatus according to claim 14, wherein the linkage includes a first link rotatably coupled to the crank, a second link supported by the linear motion guide, and a joint coupling the first link to the second link.

16. The polishing apparatus according to claim 15, wherein the polishing-head driving mechanism further includes a mount base to which the motor is secured, wherein the linear motion guide is secured to the mount base.

17. The polishing apparatus according to claim 8, wherein the polishing tool is a polishing tape having abrasive grains on a surface thereof.

* * * * *